US005725200A

United States Patent [19]

Gordon

[11] Patent Number: 5,725,200

[45] Date of Patent: Mar. 10, 1998

[54] SNATCH BLOCK ASSEMBLY

[76] Inventor: William F. Gordon, 18775 W. State Line Rd., Antioch, Ill. 60002

[21] Appl. No.: 808,401

[22] Filed: Feb. 28, 1997

[51] Int. Cl.[6] ..... B66D 1/00

[52] U.S. Cl. ..... 254/398; 254/415; 242/157 R

[58] Field of Search ..... 226/189, 90, 91; 242/157 R, 615.3; 254/394, 398, 401, 402, 405, 409, 415; 114/364, 268, 218, 230

[56] References Cited

U.S. PATENT DOCUMENTS

| | | | |
|---|---|---|---|
| 142,834 | 9/1873 | Ashford | 254/398 |
| 215,224 | 5/1879 | Hurd . | |
| 439,957 | 11/1890 | Kellogg . | |
| 462,983 | 11/1891 | Martin . | |
| 522,524 | 7/1894 | Hook . | |
| 2,121,694 | 6/1938 | Hill | 384/46 |
| 2,202,937 | 6/1940 | Wolfe | 242/157 R |
| 3,012,756 | 12/1961 | Cronkright | 254/402 |
| 3,128,992 | 4/1964 | Luketa | 254/415 |
| 3,145,016 | 8/1964 | Leithiser, Jr. | 254/398 |
| 3,486,206 | 12/1969 | McCarthy | 254/409 |
| 3,834,674 | 9/1974 | Jackson . | |
| 3,899,093 | 8/1975 | Allen . | |
| 4,019,715 | 4/1977 | Vugrek . | |
| 4,213,597 | 7/1980 | Rayner . | |
| 4,285,501 | 8/1981 | Schneider . | |
| 5,364,075 | 11/1994 | Montgomery . | |
| 5,368,281 | 11/1994 | Skyba . | |
| 5,373,605 | 12/1994 | Austin . | |
| 5,387,186 | 2/1995 | Edland . | |
| 5,449,154 | 9/1995 | Lob . | |
| 5,538,223 | 7/1996 | Scace et al. . | |

OTHER PUBLICATIONS

Snatch Blocks, p. 77, undated.

*Primary Examiner*—Katherine Matecki

*Attorney, Agent, or Firm*—Andrus, Sceales, Starke & Sawall

[57] ABSTRACT

A snatch block assembly for engaging a line between its ends includes a pair of arms mounted at their inner ends to a base. Engagement structure, in the form of a roller, is mounted to the outer end of each arm. The arms are either fixed in position relative to the base or are pivotably mounted to the base. The line is engageable with the engagement structure by inserting a line between the arms, with the portion of the line engaging the arms being parallel to the axes of rotation of the rollers. The line is then moved into engagement with the rollers so as to pass through a passage defined between the facing surfaces of the arms. The rollers thus engage the line between its ends to temporarily maintain the line in a desired position. When the arms are pivotably mounted to the base, movement of the line between the arms engages side edges of the arms to move the arms apart, and a biasing mechanism such as a spring moves the arms back together when the line is moved into engagement with the rollers. The line is engaged with the snatch block assembly without the need for manual operation of a latching or unlatching mechanism. This greatly simplifies engagement of the line and disengagement of the line from the snatch block assembly.

24 Claims, 3 Drawing Sheets

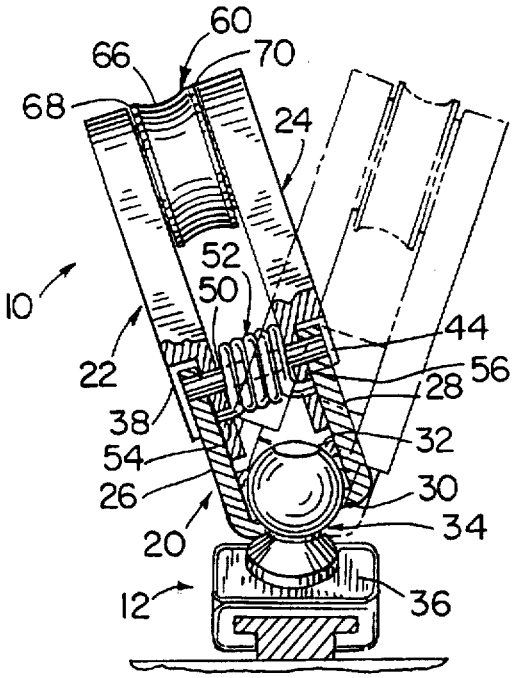
FIG. 4
FIG. 5
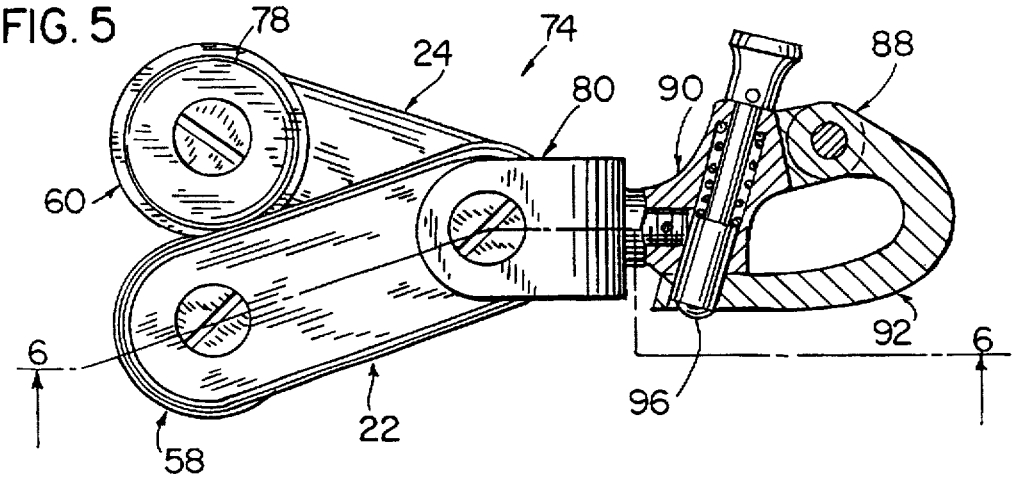
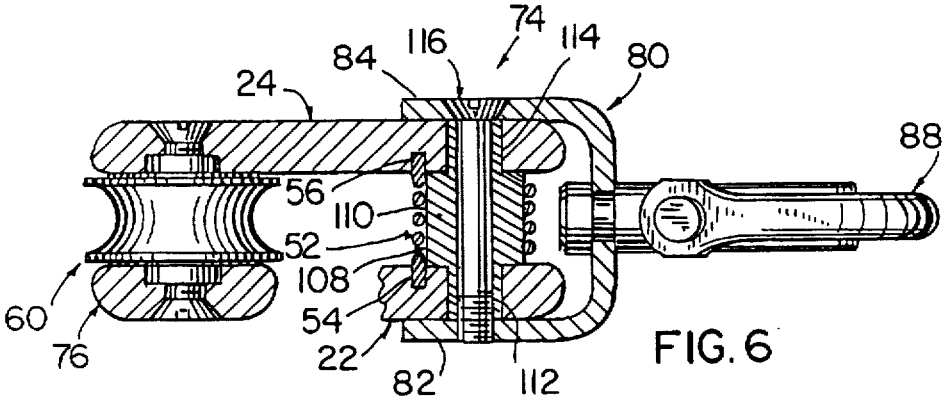
FIG. 6

SNATCH BLOCK ASSEMBLY

CROSS-REFERENCE TO RELATED APPLICATIONS

Not applicable.

STATEMENT REGARDING FEDERALLY SPONSORED RESEARCH 0R DEVELOPMENT

Not applicable.

BACKGROUND AND SUMMARY OF THE INVENTION

This invention relates to a device, commonly known as a snatch block, for temporarily engaging a line between its ends.

Snatch blocks are commonly used in sailing to adjust sail position by engaging a rope or line connected to the sail. A snatch block can either be fixed in a predetermined position on a boat, or it can include a removable mounting arrangement for quick connection to, and disconnection from, an engagement structure fixed to the boat, e.g. a hook or an eye. A sailor selectively engages sail lines with one or more snatch blocks at various locations on the sailboat, to change sail position according to wind direction and speed, as is well known.

Typically, a snatch block is an assembly which includes a roller and a retainer mechanism for temporarily maintaining the line in engagement with the roller. The retainer mechanism includes a manually operated spring-biased lever or other closure, which must be moved to an open position by the user while the line is being engaged with the roller. The lever or closure typically requires the user to use both hands to open the snatch block for placing the line into the snatch block, and two hands to close the snatch block after placement of the line. These steps can be time consuming and difficult to carry out.

It is an object of the present invention to provide a fixed position snatch block which can be opened without having to operate a closure or lever and while the user is holding the line with one hand, to simplify engagement of the line with the snatch block roller. It is a further object of the invention to provide such a snatch block which is relatively simple in its components and assembly, and which nonetheless provides highly satisfactory hands-free engagement of the line with the snatch block. A further object of the invention is to provide a movable snatch block which can be opened without having to operate a closure or lever, in order to simplify engagement of the line with the snatch block. A still further object of the invention is to provide a snatch block which can be easily opened or closed regardless of the manner in which the snatch block is mounted to a support surface.

In accordance with the invention, a snatch block assembly for engaging a line between its ends consists of a base engageable with a support and a pair of arms extending outwardly from and movably mounted to the base. Each arm defines an inner end mounted to the base and an outer end spaced from the base, and line-engaging structure is provided on the outer end of each arm. The line-engaging structure may take any satisfactory form, and preferably consists of a roller mounted to the outer end of each arm. The line is engaged by inserting the line between the arms and by moving the line toward the base. The line is then moved into engagement with the rollers to complete the attachment of the line between its ends. The rollers preferably include aligned grooves within which the line is received. The arms, to which the rollers are mounted, are laterally offset from each other. The base is preferably in the form of a U-shaped member having a pair of spaced legs and a transverse member extending therebetween. An arm is mounted to each leg of the base. The base can be mounted to any satisfactory support. For example, a ball can be fixed to a stationary support and the base includes a bearing structure engageable with the ball, to provide pivoting movement of the snatch block assembly relative to the stationary support. Alternatively, a hook structure can be mounted to the transverse member of the base, for releasably mounting the base to an eye or to any other stationary structure as desired.

In one aspect of the invention, a torsion spring is interposed between the arms for urging the arms toward a closed position in which the rollers at the outer ends of the arms are engaged with each other. The arms are each pivotably mounted to the base by means of a pin extending through each arm and interconnected with the base.

In another aspect of the invention, a torsion spring is interposed between the arms for urging the arms toward a closed position in which the rollers at the outer ends of the arms are engaged with each other. The arms are pivotably mounted to opposite ends of a bushing which defines a passage therethrough, and the bushing and the arms are engaged with the base via a threaded screw or the like which extends between the base legs and through the bushing passage. The bushing extends through the spring to maintain the spring in position relative to the arms.

In yet another aspect of the invention, the arms are non-movably and fixedly joined to each other and are movably mounted on the base. Preferably, the arms are integrally molded together and include a diverging ramp surface.

The invention further contemplates methods of engaging a line between its ends, substantially in accordance with the foregoing summary.

Various other features, objects and advantages of the invention will be made apparent from the following description taken together with the drawings.

BRIEF DESCRIPTION OF THE SEVERAL VIEWS OF THE DRAWING

The drawings illustrate the best mode presently contemplated of carrying out the invention.

In the drawings:

FIG. 4 is a front elevation view of the snatch block assembly of FIGS. 1–3;

FIG. 5 is a side elevation view of a first alternative embodiment of a snatch block assembly constructed according to the invention, showing the snatch block assembly mounted to a hook-type device for releasably mounting the snatch block assembly;

FIG. 6 is a partial section view taken along line 6—6 of FIG. 5;

DETAILED DESCRIPTION OF THE INVENTION

Figure 1:
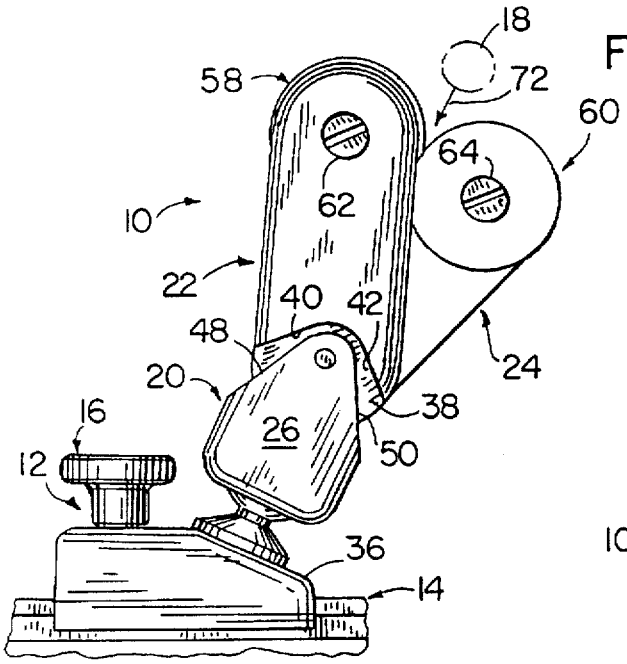
FIG. 1 is a side elevation view of a fixed position snatch block assembly constructed according to the invention, showing the arms in their closed position.

Referring to FIGS. 1–4, a snatch block assembly 10 constructed according to the invention is shown mounted to a stationary support 12, which is slidably mounted to a rail 14 and selectively fixed in position relative to rail 14 via a hand-operated blocking knob 16. Snatch block assembly 10 is used to temporarily engage a line 18 between its ends, and is well suited for use on a sailboat or the like for adjusting the sheeting position of a sail to which one of the ends of line 18 is connected, in a manner as is known. Support 12 and rail 14 are mounted to the sailboat in any desired location on the sailboat deck.

Figure 3:
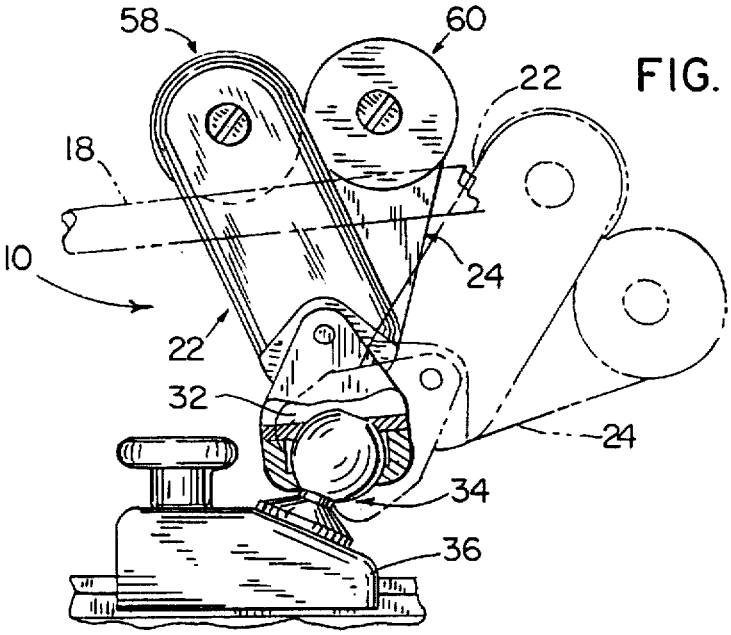
FIG. 3 is a view similar to FIGS. 1 and 2, showing pivoting movement of the snatch block assembly to various positions relative to a stationary support.

Snatch block assembly 10 includes a base 20 to which a pair of arms 22, 24 are mounted. Base 20 includes a pair of spaced parallel legs 26, 28 between which a lower transverse member 30 extends. A bearing member 32 is mounted between legs 26, 28 above transverse member 30, and bearing member 32 and transverse member 30 include spherical bearing surfaces which engage a ball 34 fixed to an angled surface 36 provided on support 12. As shown in FIGS. 3 and 4, this mounting of base 20 to ball 34 provides adjustability in the orientation of snatch block 10 relative to support 12, in a front-rear direction as shown in FIG. 3 and in a side-side direction as shown in FIG. 4.

Arms 22, 24 define inner ends which are pivotably mounted to each other and to base 20. A recess 38 is formed at the inner end of arm 22, defining a pair of walls 40, 42. A similar recess 44 is formed in the inner end of arm 24. Legs 26, 28 of base 20 are received within recesses 38, 44, respectively, and each of legs 26, 28 includes side edges, such as shown in FIG. 1 at 48, 50, terminating in a rounded outer end. A pin 50 is mounted within aligned openings formed in the outer ends of base legs 26, 28, extending through aligned openings formed in the inner ends of arms 22, 24 to pivotably mount arms 22, 24 to base legs 26, 28, respectively, and to each other. Pin 50 extends through a torsion spring 52, which includes ends 54, 56 engaged with the inner ends of arms 22, 24, respectively.

Rollers 58, 60 are mounted to the outer ends of arms 22, 24, respectively. Rollers 58, 60 are each in the form of a conventional pulley mounted for free rotation to arms 22, 24, respectively via threaded screws such as 62, 64. Each of rollers 58, 60 defines a peripheral outwardly facing concave surface 66 defining a groove located between peripheral edges 68, 70.

As shown in FIG. 4, arms 22, 24 are laterally offset from each other, being mounted to the spaced legs 26, 28, respectively, of base 20. The spacing between arms 22, 24 is such that rollers 58, 60 are in lateral alignment with each other, such that their outer peripheral grooves are aligned with and face each other. With this arrangement, the outer edges, such as 68, 70, of each of rollers 58, 60 engage each other when arms 22, 24 are in their FIG. 1 position.

Torsion spring 52 functions to bias arms 22, 24 toward their closed position of FIG. 1 in which the side edges, such as 68, 70 of rollers 58, 60 are in engagement.

Figure 2:
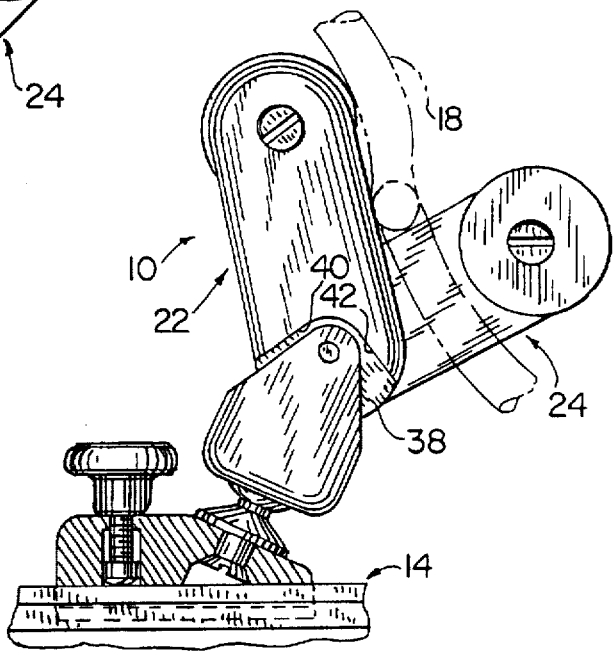
FIG. 2 is a view similar to FIG. 1, showing the arms moved apart to their open position by inserting a line therebetween.

In operation, line 18 is engaged with snatch block assembly 10 by first positioning line 18 such that line 18 is oriented transversely relative to arms 22, 24 and substantially parallel to the axes of rotation of rollers 58, 60, as shown in FIG. 1. Line 18 is then moved toward arms 22, 24 and rollers 58, 60, in the direction of arrow 72 (FIG. 1), toward base 20 such that line 18 engages rollers 58, 60 and the edges of arms 22, 24. This movement of line 18 functions to move arms 22, 24 to an open position, as shown in FIG. 2, against the force of torsion spring 52. Line 18 is then moved so as to be perpendicular relative to the axes of rotation of rollers 58, 60, and is engaged with the grooves of rollers 58, 60, to the position illustrated in FIG. 3. This engages line 18 with rollers 58, 60 between the ends of line 18. If desired, support 12 can be moved on rail 14, either before or after line 18 is mounted to snatch block assembly 10, to adjust the position of snatch block assembly 10 as desired in order to attain the desired sail sheeting position.

Line 18 is disengaged from snatch block assembly 10 by the user grasping line 18 on either side of snatch block assembly 10 and first exerting a downward force toward base 20 to disengage line 18 from rollers 58, 60. Line 18 is then rotated to a position in which a portion of line 18 is oriented perpendicularly to arms 22, 24 and parallel to the axes of rotation of rollers 58, 60. This engages the facing side edges of arms 22, 24 to force arms 22, 24 apart, as shown in FIG. 2, and line 18 is withdrawn from between arms 22, 24. The edges of arms 22, 24 and rollers 58, 60 ride on line 18 as it is being withdrawn, and arms 22, 24 then are forced by spring 52 to their closed position of FIG. 1.

It can thus be appreciated that line 18 can be engaged with and disengaged from snatch block assembly 10 without the need for a separate manual operation to open or close a latch mechanism allowing the line to be engaged with or disengaged from the snatch block. Arms 22, 24 are opened by the action of forcing the line between the arms, and automatically return to their closed position after line 18 is engaged with rollers 58, 60 to maintain line 18 in position. This substantially simplifies engagement of a line with a snatch block assembly, making it much quicker and easier to engage the line with the snatch block assembly and disengage the line therefrom to ease changes in sail sheeting positions.

It is to be understood that, while the invention has been described with reference to application in a sailing environment, it is understood that snatch block assembly 10 could be used in any other application in which a line is temporarily engaged between its ends.

FIGS. 5 and 6 illustrate a first alternative embodiment of the invention in the form of a snatch block assembly 74, and like reference characters will be used where possible to facilitate clarity. Arms 22 and 24 are constructed similarly as in the embodiment of FIGS. 1–4, excepting that no recesses, such as 38, are formed at the inner ends of each arm. Rollers 58, 60, as before, are mounted to the outer ends of arms 22, 24, respectively. In the embodiment of FIGS. 5 and 6, mounting discs 76, 78 are used to mount rollers 58, 60, respectively, to the outer ends of arms 22, 24, respectively.

Arms 22, 24 are mounted at their inner ends to a conventionally constructed hook assembly, including a U-shaped base 80 having a pair of legs 82, 84, and to which a hook assembly 88 is mounted for releasably mounting snatch block assembly 74 to an eye-bolt or any other stationary structure defining an opening therethrough, or to a line. In accordance with known construction, hook assembly 88 includes a hook member 92 and a retaining pin 96 for selectively maintaining hook member 92 in its closed position of FIG. 5 or enabling hook member 92 to pivot to an open position.

In the embodiment of FIGS. 5 and 6, a bushing 108 is employed to mount arms 22, 24 to base legs 82, 84, respectively. Bushing 108 includes a cylindrical central portion 110 and a pair of reduced-diameter end portions 112, 114 which are received within aligned openings formed in the inner ends of arms 22, 24, respectively. Bushing central portion 110 extends through spring 52, and ends 54, 56 of spring 52 are engaged with arms 22, 24, respectively, to bias arms 22, 24 toward their closed position. A threaded screw 116 extends through an axial passage formed in bushing 108 and into engagement with aligned openings formed in base legs 82, 84 to pivotably mount arms 22, 24 to base 80 and to each other.

The operation of snatch block assembly 74 of FIGS. 5 and 6 is similar to that described above with respect to snatch block assembly 10 of FIGS. 1–4. With this embodiment, the user grasps snatch block assembly 74 with one hand and the line with the other hand. While pulling on the line to tension it, the user moves snatch block 74 and the line together, with the line oriented transverse to the snatch block legs as in FIG. 1. Snatch block 74 is then turned 90° to position the line as in FIG. 3 such that the line is received within the grooves of rollers 58, 60.

Figure 10:
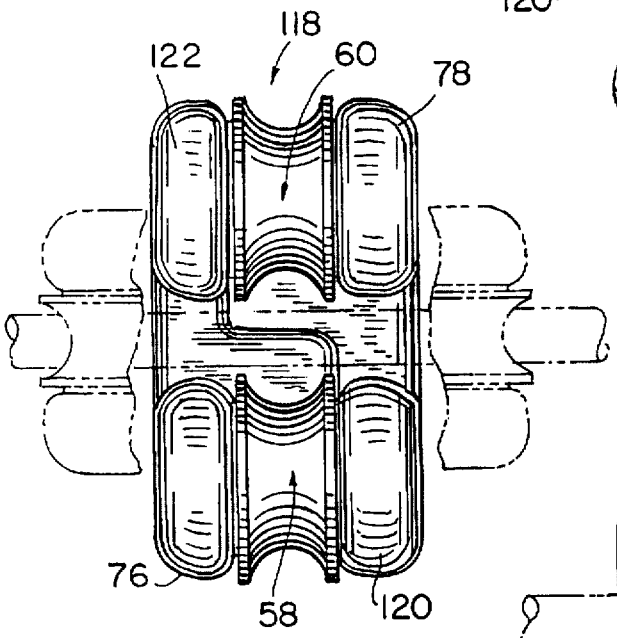
FIG. 10 is a rotated top view of the snatch block assembly of FIG. 7.

FIGS. 7–10 illustrate a second alternative embodiment of the invention in the form of a snatch block assembly 118, and again, like reference characters will be used where possible to facilitate clarity. In contrast to the embodiments of FIGS. 16, arms 120 and 122 are curved in shape, are fixed relative to each other and require no biasing arrangement to be interposed therebetween. Instead, each arm 120 and 122 sweeps outwardly and upwardly from its inner end so that the arms are joined together in a permanently spaced apart, laterally offset relationship. A gap 124 defines the permanent spacing between the arms 120 and 122. Rollers 58, 60 as before are mounted for free rotation to the outer ends of arms 120, 122, respectively, using threaded fasteners 123, 125, respectively. Also as before, mounting disks 76, 78 are used to mount rollers 58, 60, respectively, to the outer ends of arms 120, 122, respectively. Because of the fixed nature of the arms 120, 124, rollers 58, 60 are held in alignment with but spaced from each other such as shown in FIG. 10.

Figure 9:
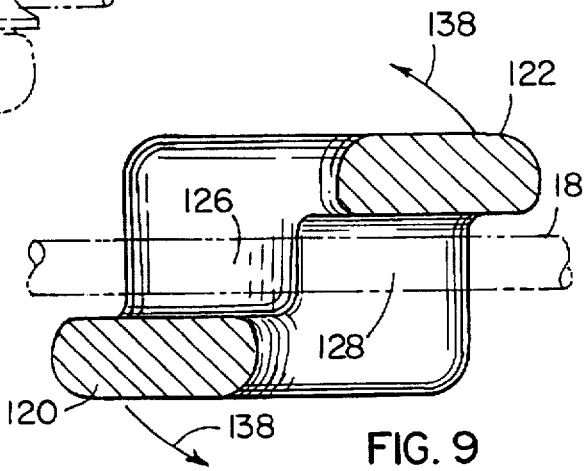
FIG. 9 is a partial section view taken on line 9—9 of FIG. 7.

As seen in FIG. 9, each of the inner ends of arms 120, 122 has an inwardly facing structure and an outwardly facing structure. The inwardly facing arm structure includes a pair of diverging ramp surfaces 126, 128 which smoothly merge together at a junction 130 and serve to offset and space the arms 120, 122 from each other. The outwardly facing arm structure includes recess 38 having walls 40, 42 similar to the embodiments of FIGS. 1–4.

Snatch block assembly 118 includes base 20 on which arms 120, 122 are movably mounted as a unit. The legs 26, 28 of base 20 are received in each recess 38 as previously described. A threaded screw 132 is mounted within aligned openings formed in the outer ends of legs 26, 28 and extending through aligned openings in the inner ends of arms 120, 122 to pivotably mount arms 120, 122 to base legs 26, 28. A fastener 134 (FIG. 8) passes through transverse member 30 of base 20 to pivotably mount the base 20 to a hook assembly or support structure as previously described.

Figure 7:
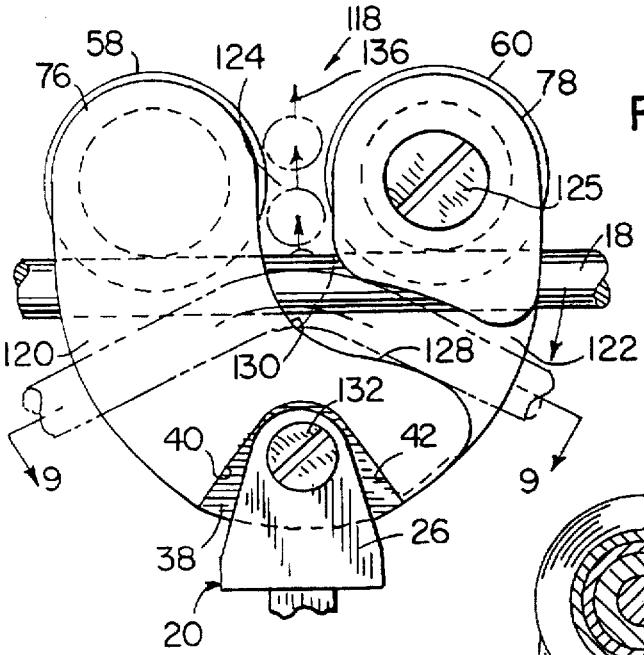
FIG. 7 is a side elevational view of a second alternative embodiment of a snatch block assembly constructed according to the invention.
Figure 8:
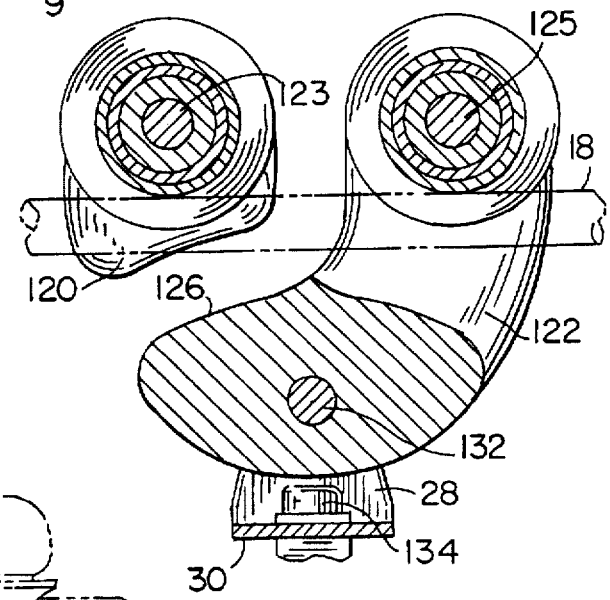
FIG. 8 is a partial section view with parts broken away of the snatch block assembly of FIG. 7.

In operation, line 18 is engageable with snatch block assembly 118 by first positioning line 18 in gap 124 such that line 18 is oriented transversely relative to arms 120, 122 and substantially parallel to the axes of rotation of rollers 58, 60 as shown in FIG. 7. Line 18 is then moved in the direction opposite the arrows 136 toward base 20 such that line 18 engages the sides of arms 120, 122 just above junction 130. In some cases depending on its diameter, the line 18 will also contact the facing portions of the rollers 58, 60 in the gap 124. Line 18 is then moved so as to be perpendicular relative to the axes of rotation of rollers 58, 60 and is engaged with the grooves of the rollers 58, 60 as shown in full lines in FIG. 7. This engages line 18 with rollers 58, 60 between the ends of line 18.

Line 18 is disengaged from snatch block assembly 118 by the user grasping line 18 on either side of snatch block assembly 118 and exerting a downward force to place line 18 along ramp surfaces 126, 128 so as to disengage line 18 from rollers 58, 60. Then, as shown by the arrows 138 in FIG. 9, snatch block assembly 118 and/or line 18 are swiveled to a position shown in FIG. 10 in which a portion of line 18 is oriented perpendicularly to arm 120, 122 and parallel to the axes of rotations of rollers 58, 60. This places line 18 between arms 120, 122 such that the line may be withdrawn upwardly from between arms 120, 122, as shown by the arrows 136 in FIG. 7.

The above description of the operation of snatch block 118 applies equally to situations in which snatch block assembly 118 is fixed in position and in which snatch block assembly 118 includes a removable mounting arrangement such as hook assembly 88.

With the arrangement of snatch block assembly 118, it can be further appreciated that line 18 can be engaged with and disengaged from snatch block assembly 118 without the need for arms to be movably mounted relative to each other and without the need for a biasing arrangement to regulate opening and closing between the arms. This further simplifies engagement of line 18 with a snatch block assembly making it even easier to engage line 18 with a snatch block assembly and disengage the line therefrom to facilitate changes in sale sheeting positions.

Various alternatives and embodiments are contemplated as being within the scope of the following claims particularly pointing out and distinctly claiming the subject matter regarded as the invention.

While the invention has been described with reference to a preferred embodiment, those skilled in the art will appreciate that certain substitutions, alterations and omissions may be made without departing from the spirit thereof. Accordingly, the foregoing description is meant to be exemplary only, and should not be deemed limitative on the scope of the invention set forth with following claims.

I claim:

1. A snatch block assembly for engaging a line between its ends, comprising:

a base engageable with a support;

first and second spaceable arms extending from and movably mounted to the base, each arm defining an inner end mounted to the base and an outer end spaced from the inner end; and line-engaging structure provided on the outer end of each arm;

wherein the line is capable of being engaged with one of the line-engaging structures by inserting the line between the arms and engaging the arms, moving the line toward the base, and moving the line into engagement with the line-engaging structures.

2. The snatch block assembly of claim 1, wherein the arms are each pivotably mounted to the base adjacent the inner end of each arm.

3. The snatch block assembly of claim 2, wherein the roller peripheral grooves are aligned with each other when the arms are in their closed position, and wherein the grooves cooperate to enclose the line at the point of engagement between the rollers.

4. The snatch block assembly of claim 1, further comprising a biasing arrangement interposed between the arms for urging the arms towards a closed position in which the line-engaging structures on the arms engage each other, wherein the arms are movable to an open position against the force of the biasing arrangement in which the line-engaging structures are moved apart, and wherein the arms are returnable to their closed position to maintain engagement of the line with their line-engaging structure.

5. The snatch block assembly of claim 1, wherein the line-engaging structure provided on the outer end of each arm comprises a roller having a peripheral groove adapted to receive the line.

6. The snatch block assembly of claim 5, wherein the arms are laterally offset from each other, and wherein the rollers are in lateral alignment with each other.

7. The snatch block assembly of claim 1, wherein the arms are pivotably mounted to the base adjacent the inner end of each arm, and wherein the biasing arrangement comprises a spring engaged with the inner end of each arm and urging the arms towards their closed position.

8. The snatch block assembly of claim 7, wherein the arms are pivotably mounted to the base by means of a pin extending through each arm and interconnected with the base, and wherein the spring comprises a torsion spring through which the pin extends.

9. The snatch block assembly of claim 1, wherein each of the arms are fixedly joined to each other adjacent the inner end of each arm.

10. The snatch block assembly of claim 1, wherein the arms are integrally formed together.

11. A snatch block assembly for engaging a line between its ends, comprising:

a base engageable with a support;

an arm extending from the base and defining an inner end mounted to the base and an outer end spaced from the inner end;

line-engaging structure mounted to the arm adjacent its outer end;

a movable retainer having an outer end located adjacent the line-engaging structure; and bias means for urging the retainer outer end into engagement with the line-engaging structure;

wherein the line is capable of being engaged with the line-engaging structure by inserting the line between the arm and the retainer, moving the line toward the base to move the arm and the retainer apart to disengage the retainer and the line-engaging structure, and moving the line into engagement with the line-engaging structure, wherein the bias means returns the retainer member into engagement with the line-engaging structure to maintain engagement of the line therewith.

12. A method of engaging a line between its ends, comprising the steps of:

providing a snatch block assembly having a base, a pair of spaceable arms movably mounted on the base and line-engaging structure provided on at least a first one of the arms;

inserting the line between the arms by engaging the arms with the line;

moving the line towards the base; and moving the line into engagement with the line-engaging structure.

13. A method of engaging a line between its ends, comprising the steps of:

providing a snatch block assembly having a pair of pivotable arms mounted on the base and line-engaging structure provided on at least a first one of the arms;

biasing the arms towards each towards a closed position in which a second one of the arms engages the line-engaging structure on the first arm;

inserting the line between the arms by engaging the arms with the line to move the arms away from their closed position to an open position; and moving the line into engagement with the line-engaging structure and out of engagement with the arms, wherein the biasing of the arms functions to return the arms to their closed position to maintain engagement of the line with the line-engaging structure.

14. In a snatch block assembly including a base, an arm having a first end mounted to the base and extending outwardly from the base and terminating in a second end, and a roller mounted to the outer end of the arm, the improvement comprising:

a retainer movably interconnected with the base; and a spring interconnected with the retainer for urging the retainer towards a closed position into engagement with the roller;

wherein the line is capable of being engaged with the roller by inserting the line between the arm of the retainer, moving the line toward the base to move the arm of the retainer apart to disengage the retainer and the roller, and moving the line into engagement with the roller, wherein the bias means returns the retainer into engagement with the roller to maintain engagement of the line therewith.

15. The improvement of claim 14, wherein the retainer comprises a second arm having an inner end mounted to the base and terminating in an outer end, and a second roller mounted to the outer end of the second arm and engageable with the first-mentioned roller, wherein the spring is interconnected with the second arm for biasing the second arm towards its closed position in which the second roller engages the first-mentioned roller.

16. The improvement of claim 15, wherein the first-mentioned and second arms are pivotably mounted to the base by means of a pin extending between and interconnecting the base and the first-mentioned and second arms.

17. The improvement of claim 16, wherein the spring comprises a torsion spring through which the pin extends and is interconnected with the first-mentioned and second arm for urging the first-mentioned and second rollers together.

18. The improvement of claim 14, wherein the base comprises a U-shaped member having a pair of spaced legs and a transverse member extending therebetween, and wherein the arm is pivotably mounted to a first one of the pair of legs, and wherein the retainer comprises a second arm pivotably mounted to a second one of a pair of legs.

19. The improvement of claim 18, further comprising a bushing to which a first-mentioned and second arms are pivotably mounted, and wherein the bushing is disposed between and mounted to the pair of legs defined by the base.

20. The improvement of claim 19, wherein the bushing defines a passage therethrough and is mounted to the legs via a connector extending through the bushing passage and mounted to the pair of legs.

21. A snatch block assembly for engaging a line between its ends, comprising:

a base engageable with a support;

first and second spaced arms fixedly joined to each other and movably mounted on the base, each arm defining an inner end mounted to the base and an outer end spaced from the inner end; and line-engaging structure provided on the outer end of each arm;

wherein the line is capable of being engaged with one of the line-engaging structures by inserting the line between the arms and engaging the arms, moving the line towards the base, and moving the line into engagement with one of the line-engaging structures.

22. The snatch block assembly of claim 21, wherein the arms are integrally formed together.

23. The snatch block assembly of claim 21, wherein each of the arms includes a diverging ramp surface.

24. The snatch block assembly of claim 23, wherein the line is capable of being disengaged with one of the line engaging structures by moving the line towards the base and against each of the ramp surfaces, rotating the arms to move the line to a position in which a portion of the line is oriented perpendicularly to the arms and withdrawing the line from between the arms.

* * * * *

UNITED STATES PATENT AND TRADEMARK OFFICE

CERTIFICATE OF CORRECTION

PATENT NO. : 5,725,200

DATED : March 10, 1998

INVENTOR(S) : WILLIAM F. GORDON

It is certified that error appears in the above-indentified patent and that said Letters Patent is hereby corrected as shown below:

Claim 13, column 8, line 9, delete "towards each".

Signed and Sealed this

Ninth Day of June, 1998

*Attest:*

Bruce Lehman

BRUCE LEHMAN

*Attesting Officer*

*Commissioner of Patents and Trademarks*